US008277021B2

(12) United States Patent
Kan

(10) Patent No.: US 8,277,021 B2
(45) Date of Patent: Oct. 2, 2012

(54) INK-JET RECORDING APPARATUS

(75) Inventor: Shoichi Kan, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 261 days.

(21) Appl. No.: 12/187,946

(22) Filed: Aug. 7, 2008

(65) Prior Publication Data

US 2009/0040267 A1 Feb. 12, 2009

(30) Foreign Application Priority Data

Aug. 10, 2007 (JP) ..... 2007-209185

(51) Int. Cl.
*B41J 2/165* (2006.01)

(52) U.S. Cl. ..... 347/29

(58) Field of Classification Search ..... None
See application file for complete search history.

(56) References Cited

U.S. PATENT DOCUMENTS 5,534,896 A * 7/1996 Osborne ..... 347/29
6,062,670 A * 5/2000 Iwata et al. ..... 347/23
6,481,826 B1 * 11/2002 Hara et al. ..... 347/29
6,523,929 B2 * 2/2003 Kan et al. ..... 347/22
7,201,465 B2 * 4/2007 Sakamoto et al. ..... 347/29
2003/0227505 A1 * 12/2003 Tanaka et al. ..... 347/29
2007/0159503 A1 * 7/2007 Miyake et al. ..... 347/5

FOREIGN PATENT DOCUMENTS

JP 10-109424 A 4/1998
JP 2002-347234 12/2002
JP 2004-90293 3/2004
JP 2005-329693 A 12/2005

* cited by examiner

*Primary Examiner* — Matthew Luu
*Assistant Examiner* — Alejandro Valencia
(74) *Attorney, Agent, or Firm* — Canon USA Inc. IP Division

(57) ABSTRACT

An ink-jet recording apparatus includes a first driving source, a second driving source, and a control section. The first driving source drives a cap unit. The second driving source moves a cap and a recording head in directions different from a direction along which the cap is separated from the recording head by the first driving source. The control section drives the second driving source at the same time as the cap unit is driven by the first driving source.

8 Claims, 11 Drawing Sheets

INK-JET RECORDING APPARATUS

BACKGROUND OF THE INVENTION

1. Field of the Invention

The present invention relates to ink-jet recording apparatuses, and in particular, relates to ink-jet recording apparatuses including ink-jet recording heads and cap members for protecting the heads installed in main bodies of the apparatuses.

2. Description of the Related Art

Ink-jet recording apparatuses are well known as image forming apparatuses, and used for printers and copiers due to, for example, low noise, low running costs, ease of apparatus size reduction, and ease of colorization.

In order to meet the demand for readily printing photo image data at home along with the recent popularization of digital cameras, photo printers capable of direct printing from memories or direct printing from digital cameras without using personal computers have been proposed.

Such printers are shipped as products including ink-jet recording heads preinstalled in main bodies of recording apparatuses at manufacturing factories so that the operability for a wide range of users is improved. That is, due to the so-called "preset shipping" form, it is not necessary for users to install ink-jet recording heads, which are precision components, upon receiving the printers.

In general preset shipping, ejecting surfaces of ink-jet recording heads are covered with cap members provided for main bodies of recording apparatuses such that the recording heads are protected from dust or drying.

The cap members serve as a part of a suction recovery unit for preventing reductions in quality of recorded images caused by discharge failure of the ink-jet recording heads that make a recording by discharging ink from minute nozzles thereof. In general, the cap members are composed of soft materials such as rubber and elastomer so that the hermetic state of ejecting ports of the recording heads is maintained, and in particular, often composed of materials with a high gas-barrier property such as chlorinated butyl rubber.

When such cap members with high adhesive and hermetic properties are used, the caps are sometimes firmly bonded to the ejecting surfaces of the recording heads depending on their bondability with the ejecting surfaces of the recording heads or depending on the conditions of storage environment in the distribution process after the recording apparatuses are shipped from manufacturing factories. This causes difficulty in separation of the cap members from the recording heads and operation failure of the apparatuses when the apparatuses are turned on by users.

In order to avoid operation failure of apparatuses caused by the bonding of cap members to recording heads, Japanese Patent Laid-Open Nos. 2002-347234 and 2004-90293 describe structures in which carriages having recording heads installed therein are reciprocated by a small amount before cap members are separated.

However, when the cap members bonded to the recording heads are separated from the ejecting surfaces of the recording heads in a direction perpendicular to the ejecting surfaces, it is necessary to apply a uniform force to the entire contact surfaces of the cap members. Thus, a large peeling force is required, preventing the separation of the cap members from the recording heads.

In Japanese Patent Laid-Open Nos. 2002-347234 and 2004-90293, the cap members are separated from the recording heads by moving the carriages, that is, using the so-called cap sliding mechanism. In this mechanism, the cap members are separated from the recording heads while moving relative to the carriages, and this corresponds to the separation of the cap members from the ejecting surfaces of the recording heads in the direction perpendicular to the ejecting surfaces. As a result, peeling force is not significantly reduced.

In order to separate cap members firmly bonded to recording heads from the recording heads, a large driving force and an increased strength of associated parts are required. This leads to increases in cost and size of apparatuses.

SUMMARY OF THE INVENTION

The present invention provides an ink-jet recording apparatus with high reliability and usability capable of effectively separating a cap member bonded to a recording head at low cost and only occupying a small space.

According to an aspect of the present invention, an ink-jet recording apparatus includes a recording head configured to make a recording by discharging ink onto a recording medium, a cap unit configured to hold a cap member covering an ejecting surface of the recording head and including a mechanism for separating the cap member from the recording head, a first driving source configured to drive the cap unit, a second driving source configured to move the cap member and the recording head in directions different from a direction along which the cap member is separated from the recording head by the first driving source, and a control section configured to drive the second driving source at the same time as the cap unit is driven by the first driving source.

Further features of the present invention will become apparent from the following description of exemplary embodiments with reference to the attached drawings.

DESCRIPTION OF THE EMBODIMENTS

Exemplary embodiments of the present invention will now be described with reference to the drawings.

Figure 1A:
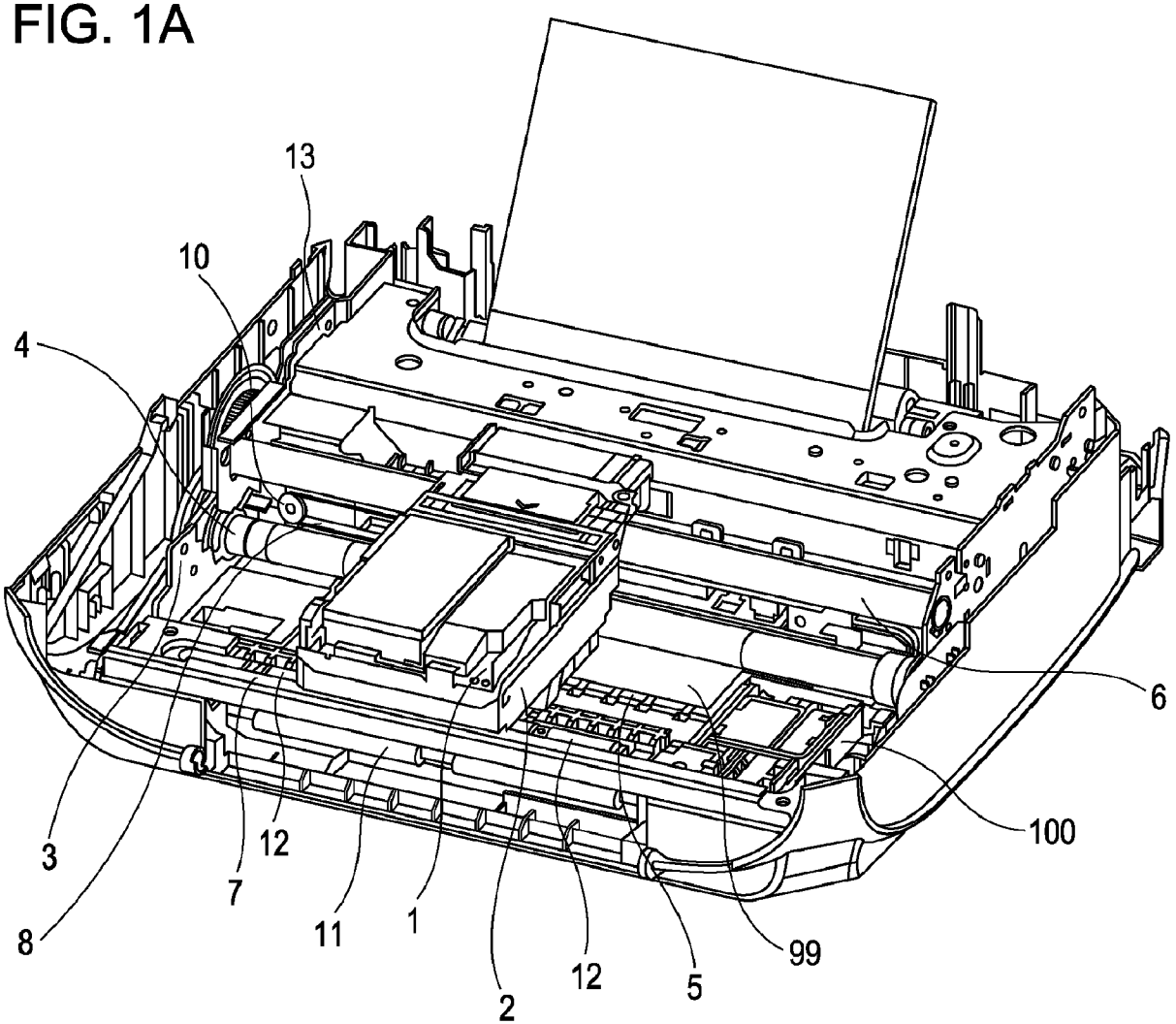
FIG. 1A is a schematic perspective view illustrating the structure of an ink-jet recording apparatus according to a first exemplary embodiment of the present invention.
Figure 1B:
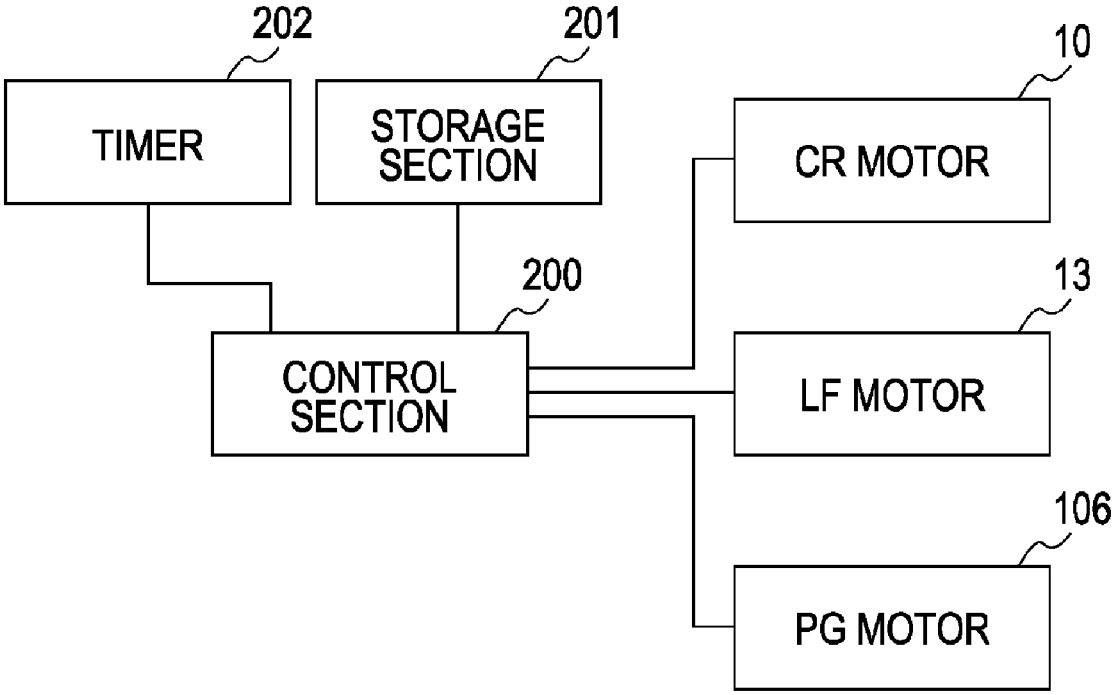
FIG. 1B is a control block diagram of the ink-jet recording apparatus according to the first exemplary embodiment of the present invention.

FIG. 1A is a schematic perspective view illustrating the structure of an ink-jet recording apparatus according to a first exemplary embodiment. FIG. 1B is a control block diagram of the ink-jet recording apparatus according to the first exemplary embodiment.

In the present embodiment, a first driving source refers to a driving source that drives a driving system of a cap including a mechanism for relatively separating a cap 103 from a recording head 1. In this exemplary embodiment, a PG motor 106 serves as the first driving source. Moreover, in the present embodiment, a second driving source refers to a driving source that relatively moves the cap 103 and the recording head 1 in directions different from that along which the cap member is separated from the recording head 1 by the first driving source. A CR motor 10 serves as the second driving source in this exemplary embodiment, and an LF motor 13 serves as the second driving source in another exemplary embodiment described below.

A carriage 2 having the recording head 1 installed therein as a recording unit is supported and guided by a guide shaft 6 and a guide rail 7 so as to be reciprocated while facing a conveying roller 4 and a platen 5 held by a chassis 3. The carriage 2 is reciprocated along the guide shaft 6 by the driving force of the CR motor 10 for driving the carriage transmitted via a belt 8 (main scanning).

A recording sheet 99 serving as a recording material (recording medium) is held between a pinch roller (not shown) facing the conveying roller 4 inside the recording apparatus and auxiliary eject rollers 12 facing an eject roller 11. In this state, the recording sheet 99 is conveyed in a direction perpendicular to the axis of the conveying roller 4 by a frictional force generated by the rotation of the conveying roller 4 driven by the driving force of the LF motor 13 for driving the conveying roller disposed at a lower portion of the apparatus as shown in FIG. 1A (sub-scanning).

For recording, the carriage 2 moves at a constant speed after being accelerated from a stopped state by the drive of the CR motor 10. In this state, the recording head 1 serving as the recording unit is driven and discharges ink toward the recording sheet 99 in accordance with recording data sent to the recording apparatus. After the driving of the recording head 1 for one line is finished, the carriage 2 is decelerated and stopped.

The conveying roller 4 is rotated by a predetermined amount by the drive of the LF motor 13 after the recording for one line is finished to convey the recording sheet 99 to a position at which the next recording portion of the recording sheet 99 faces the recording head 1. After this operation, the movement of the carriage 2 is restarted, and the recording head 1 is driven to make the next recording while moving.

All the predetermined recording data is recorded by repeating the series of operations, and the recording sheet 99 is discharged outside the recording apparatus by the eject roller 11 after the recording is completed. In this manner, the recording operation is finished.

The recording head 1 is an ink-jet recording unit that discharges ink by using thermal energy, and includes an electric thermal conversion member for generating thermal energy. Moreover, the recording head 1 makes a recording by discharging ink from ejecting ports by using pressure changes (state changes) caused by growth or contraction of bubbles by the action of film boiling generated by the thermal energy applied by the electric thermal conversion member.

In FIG. 1A, a recovering unit 100 for maintaining and recovering ink discharge performance by preventing, for example, clogging of the recording head 1 is disposed at a predetermined position outside the recording area of the recording apparatus. This unit includes a cap that covers (or caps) the ejecting surface of the recording head 1 for protecting the recording head 1 and for reducing evaporation of ink from the ejecting ports during non-recording.

Furthermore, when recording is restarted after the recording head is capped for a long period of time, it is necessary to stabilize ink discharge by removing ink (thicker ink) half-hardened in the vicinity of the ejecting ports of the recording head 1 before recording. To this end, ink is sucked out of the ejecting ports of the recording head 1 (suction process).

This suction process is performed by operating a suction pump connected to the cap while the recording head is capped.

In FIG. 1B, the ink-jet recording apparatus includes a control section 200 that controls the drive of the CR motor 10, the LF motor 13, and the PG motor 106. The ink-jet recording apparatus further includes a storage section 201 and a timer 202, and the control section 200 controls the drive of the CR motor 10, the LF motor 13, and the PG motor 106 based on the information stored in the storage section 201 or the information of the timer 202.

Figure 2:
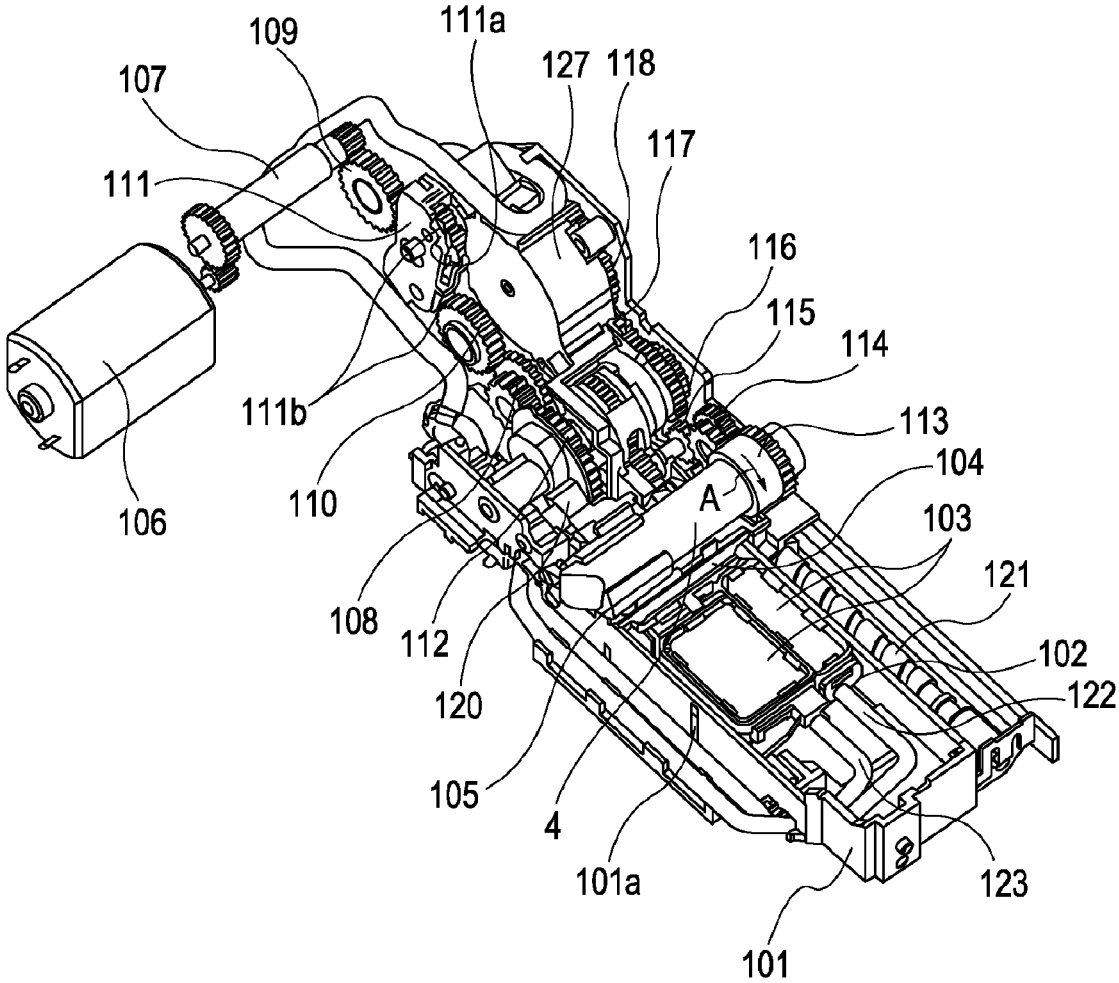
FIG. 2 is a schematic perspective view illustrating an example structure of a recovering unit of the ink-jet recording apparatus according to the first exemplary embodiment of the present invention.

FIG. 2 is a schematic perspective view illustrating an example structure of the recovering unit of the ink-jet recording apparatus.

In FIG. 2, the recovering unit 100 includes the cap 103, a wiper 104, and a carriage locking unit 105. The cap 103 is installed in a cap holder 102 capable of vertically moving along a guide 101*a* formed in a base 101 so as to cover the ejecting surface of the recording head (not shown in FIG. 2). The wiper 104 can be reciprocated on a lead screw 121 to wipe the ejecting surface of the recording head 1. The carriage locking unit 105 is disposed on the conveying roller 4 to be rotatable such that the carriage (not shown in FIG. 2) does not unnecessarily move while the ejecting surface is capped.

The cap 103 and the carriage locking unit 105 are operated by rotating a main cam 112 by transmitting the driving force of the PG motor 106 for driving the recovering unit via speed change gears 107 and 108, idler gears 109 and 110, and a pendulum 111. The pendulum 111 includes a sun gear 111*a* and planet gears 111*b*.

The rotation of the main cam 112 is converted into vertical reciprocating motion of the carriage locking unit 105 and the cap 103 by the cam surface formed on the main cam 112 and a cap lever 120.

The cap 103 includes two cap chambers integrated with each other. Suction tubes 122 and 123 connected to corresponding cap chambers and extending to a pump base 127 constitute a tube pump serving as a suction unit together with, for example, a driven suction roller (not shown) disposed inside the pump base 127.

The tube pump generates a negative pressure (suction force) by rotating the driven suction roller (not shown) such that the suction tubes 122 and 123 disposed inside the pump base are squeezed. The driven suction roller is rotated by transmitting the rotating force of the conveying roller 4 driven by the LF motor 13 to a pump gear 118 via an input gear 113 integrated into the conveying roller 4 on the axis thereof, speed change gears 114 and 116, and idler gears 115 and 117.

First ends of the suction tubes 122 and 123 communicate with the interior of the corresponding cap chambers of the cap 103 via the cap holder 102. When the tube pump is operated while these cap chambers are in close contact with the ejecting surface of the recording head 1 such that the ejecting ports are hermetically sealed (capping state), ink can be sucked out of the ejecting ports together with, for example, thicker ink and bubbles.

Waste ink sucked from the ejecting ports of the recording head 1 is discharged from second ends of the suction tubes 122 and 123 outside the recovering unit 100.

Figure 3:
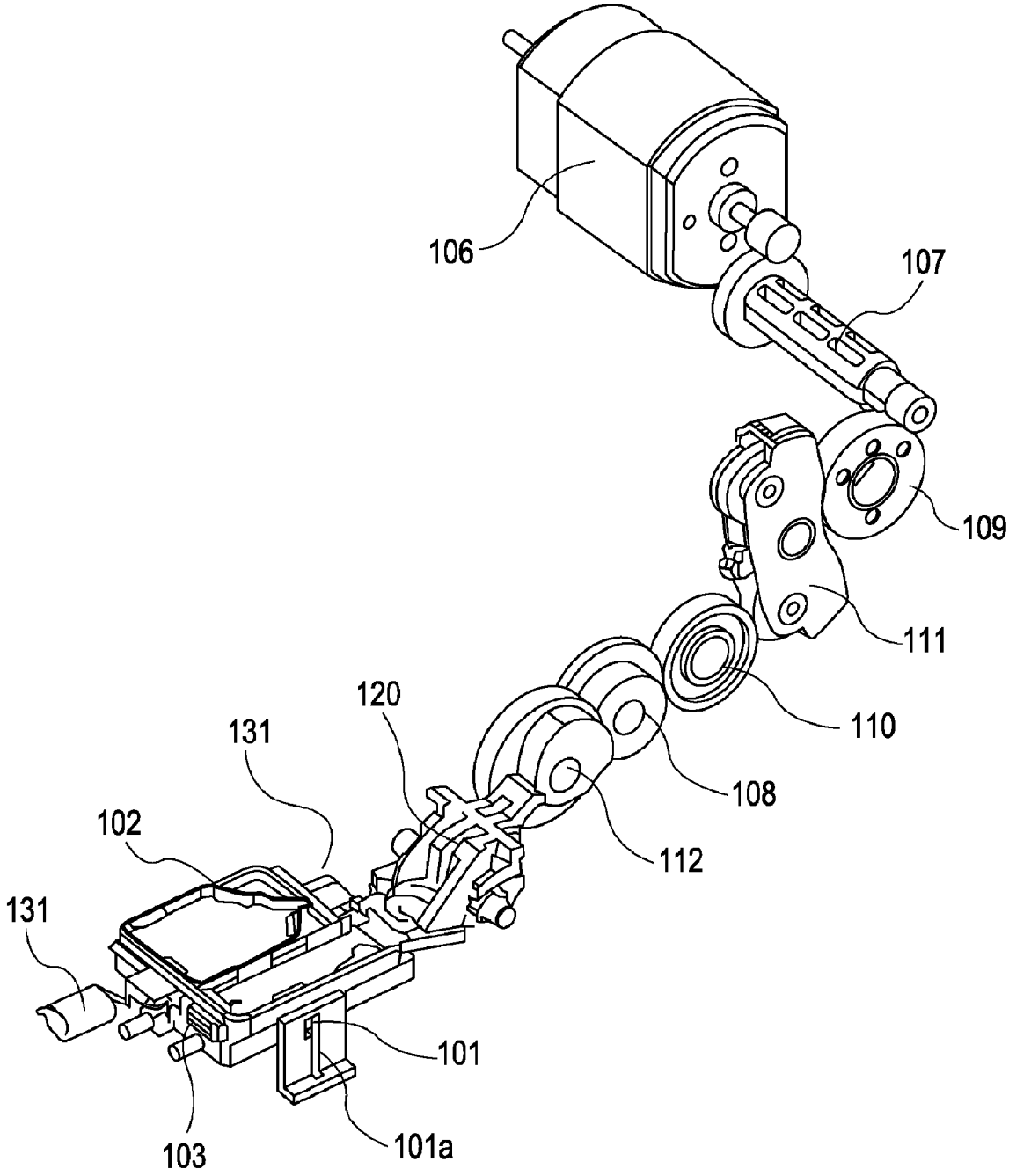
FIG. 3 is a schematic perspective view illustrating a system for driving a cap with respect to a recording head according to the first exemplary embodiment of the present invention.
Figure 4:
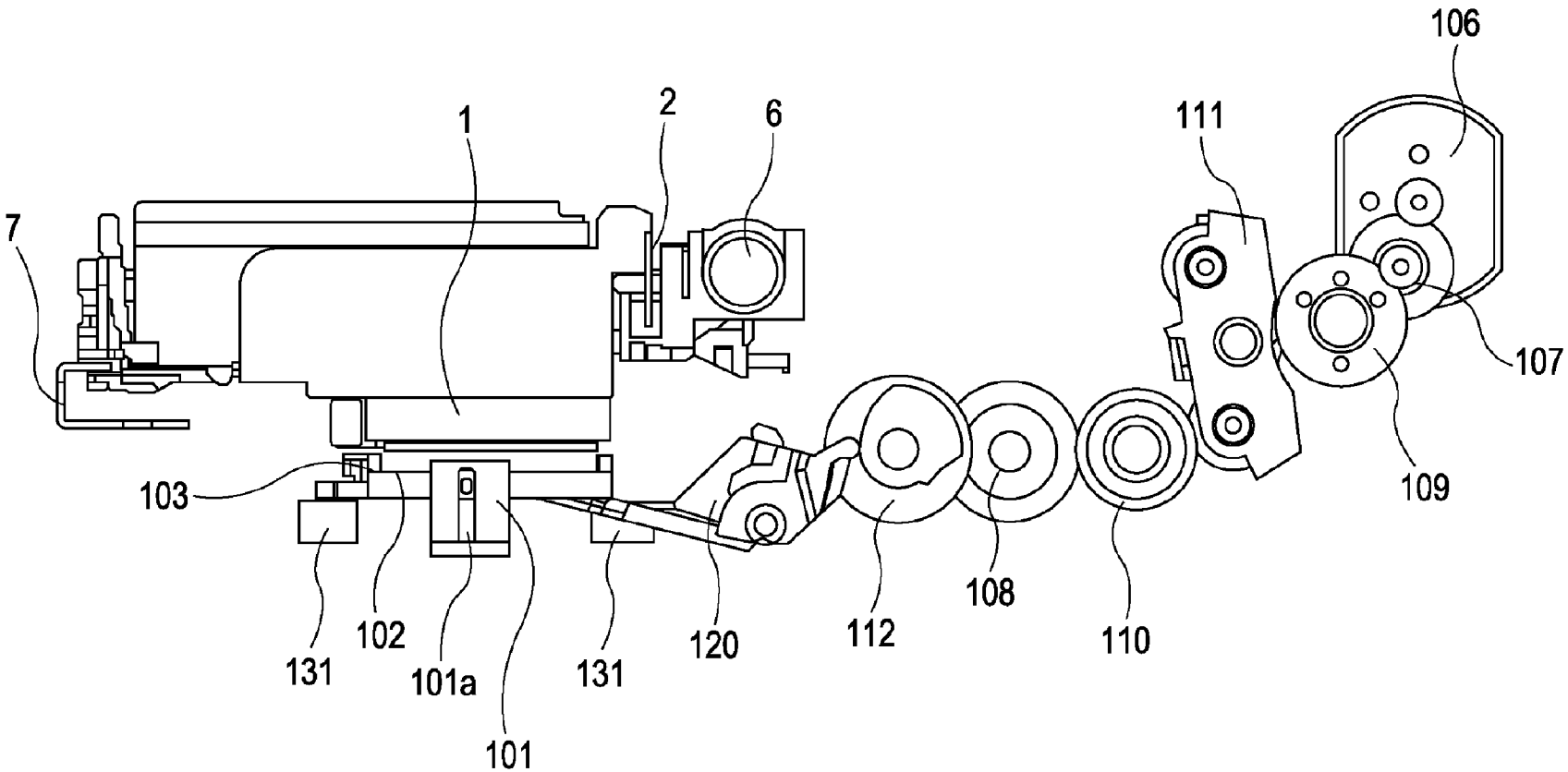
FIG. 4 is a schematic side view illustrating a capping state where the cap hermetically seals the recording head using the driving system.

FIG. 3 is a schematic perspective view illustrating a system for driving the cap with respect to the recording head. FIG. 4 is a schematic side view illustrating a capping state where the cap hermetically seals the recording head using the driving system.

In FIGS. 3 and 4, the driving force of the PG motor 106 is transmitted to the main cam 112 via the two speed change gears 107 and 108, the two idler gears 109 and 110, and the pendulum 111. A first end of the cap lever 120 is in contact with the cam surface of the main cam 112 such that the cap lever is rockable, and a second end thereof is connected to the cap holder 102 in which the cap 103 is installed such that the cap holder can be pulled down. The cap holder 102 is vertically movable along the guide 101*a* formed in the base 101, and is usually biased upward (capping direction) by cap springs 131.

The carriage 2 has the recording head 1 installed therein, and is supported and guided by the guide shaft 6 and the guide rail 7.

The so-called capping state in which the ejecting surface of the recording head 1 is covered is created when the cap 103 facing the carriage 2 is biased upward as shown in FIG. 4.

The ejecting surface of the recording head 1 is capped during normal storage to be protected from foreign substances or drying. Moreover, the suction process for stabilizing ink discharge is performed by driving the above-described pump unit in the capping state.

Figure 5:
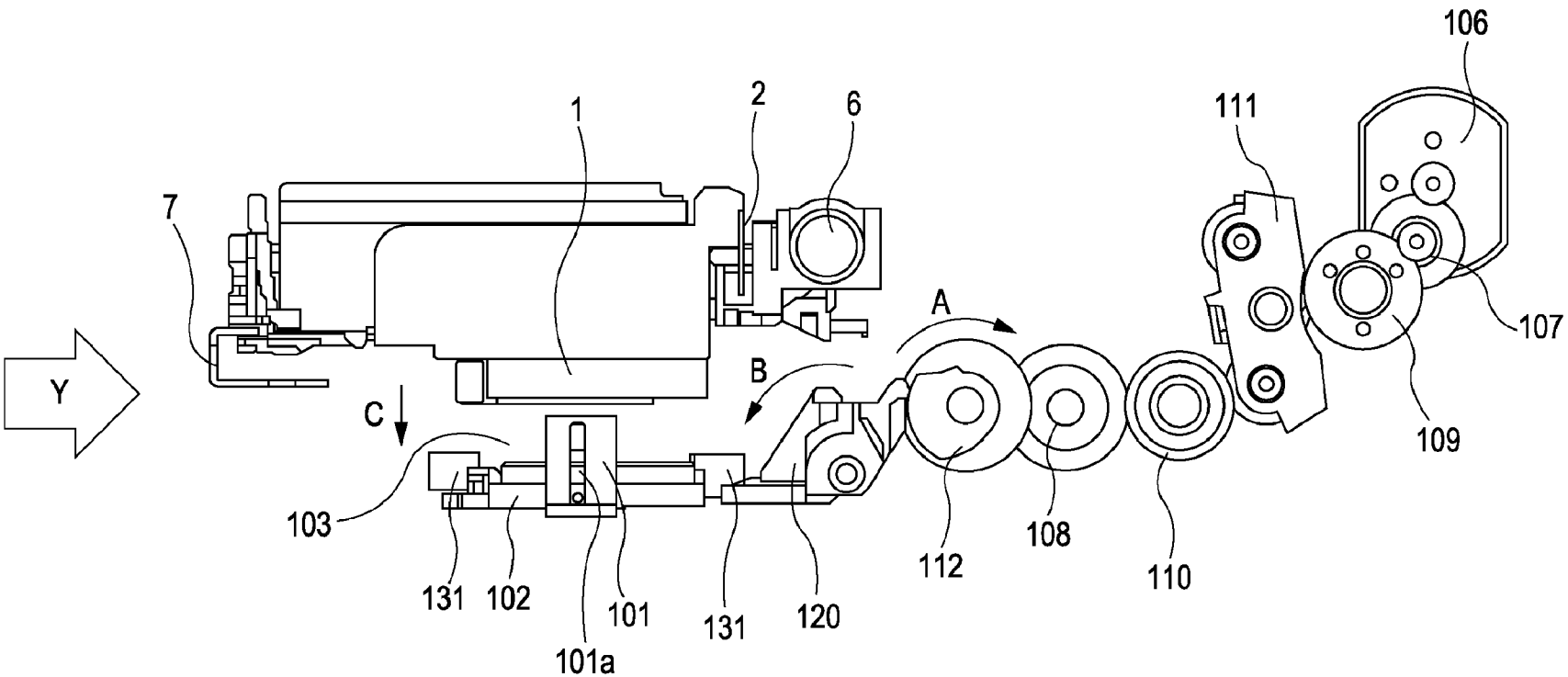
FIG. 5 is a schematic side view illustrating a cap-open state where the cap is separated from the recording head by the driving system.

FIG. 5 is a schematic side view illustrating a cap-open state where the cap is separated from the recording head by the driving system.

In FIG. 5, the main cam 112 is rotated in the direction of an arrow A by driving the PG motor 106 so that the cap lever 120 is rotated in the direction of an arrow B. With this, the cap holder 102 overcomes the biasing force of the cap springs 131, and is moved in the direction of an arrow C. In this manner, the cap 103 that was in close contact with the ejecting surface of the recording head 1 is separated from the ejecting surface.

The carriage 2 can freely move along the guide shaft (in the main scanning direction) by driving the CR motor 10 shown in FIGS. 1A and 1B while the cap 103 is completely separated from the recording head 1. A normal recording is made in this state.

As described above, the cap 103 may be firmly bonded to the ejecting surface of the recording head 1 depending on, for example, the conditions of storage environment in the distribution process after the recording apparatus in which the recording head is preinstalled is shipped from a manufacturing factory. When such a state occurs, the cap holder 102 may not be lowered to a position shown in FIG. 5 by only the driving force of the PG motor 106, and may be inoperable when the apparatus is first turned on after the apparatus has arrived at a user.

Therefore, in the first exemplary embodiment of the present invention, the following operations are performed when the cap 103 is expected to be firmly bonded to the recording head 1, for example, when a user receives the apparatus.

The CR motor (second driving source) 10 is driven while the cap 103 is separated from the recording head 1 by driving the PG motor (first driving source) 106 (separation process). With this, the recording head 1 is relatively moved together with the carriage 2 in a direction intersecting with (in this exemplary embodiment, a direction along the guide shaft 6 and orthogonal to) a direction along which the cap 103 is separated from the recording head (downward).

Figure 6:
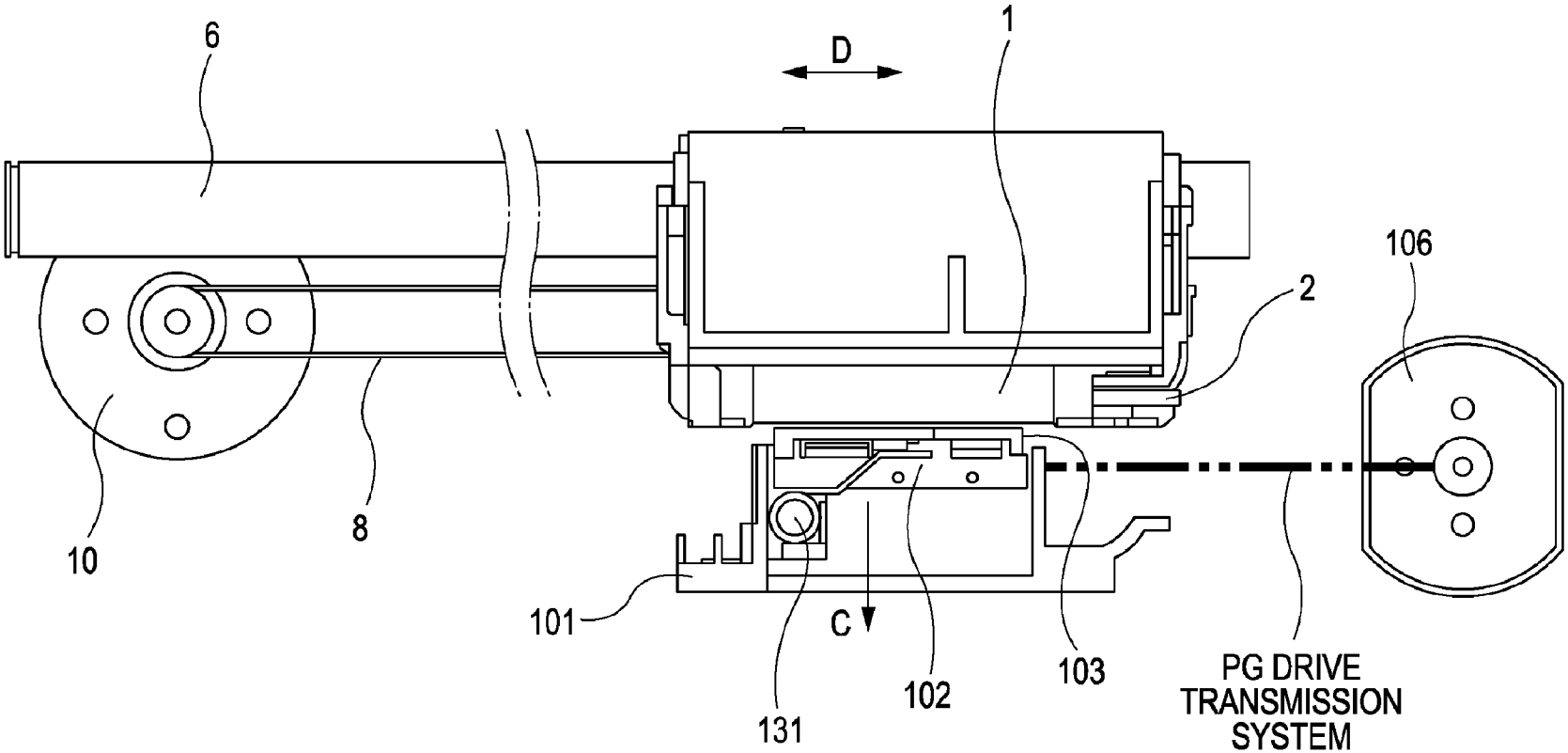
FIG. 6 is a schematic projection viewed in a Y direction in FIG. 5 illustrating the motion of a carriage and the cap.

FIG. 6 is a schematic projection viewed in a Y direction in FIG. 5 illustrating the motion of the carriage 2 and the cap 103.

As described above, the PG motor 106 is driven to lower the cap holder 102 having the cap 103 installed therein in the cap separating direction (direction of the arrow C) in this exemplary embodiment. At the same time as the cap holder is started to be lowered, the CR motor 10 is driven to move the carriage 2 having the recording head 1 installed therein along the guide shaft 6 in the main scanning direction (direction of an arrow D) by a small amount.

With this, the recording head 1 is moved in the main scanning direction orthogonal to the direction of the arrow C by the CR motor 10 at the same time as the cap 103 is separated from the ejecting surface of the recording head 1 in the direction perpendicular to the ejecting surface by the PG motor 106. In FIG. 6, "the direction perpendicular to the ejecting surface of the recording head 1" is indicated by the arrow C, and "the main scanning direction orthogonal to the direction of the arrow C" is indicated by the arrow D.

As a result, an oblique (in a direction of the resultant force in the directions of the arrows C and D) separating force acts on the contact surfaces of the cap 103 and the recording head 1.

When the cap 103 is separated from the ejecting surface of the recording head 1 in the direction perpendicular to the ejecting surface, a large peeling force is required since it is necessary to apply a uniform force to the entire contact surfaces of the recording head 1 and the cap 103. In contrast, with the above-described operations, the separating force highly advantageously acts on the contact surfaces in an oblique direction (in an uneven manner) as described above.

Since the separating force generated here is a resultant force of the driving forces of the two driving sources, the force can be large compared with the case where the force is generated by either one of the two driving sources. Therefore, the cap 103 can be reliably separated from the ejecting surface of the recording head 1 even when the contact surface of the cap 103 is firmly bonded to the ejecting surface of the recording head 1.

Figure 7:
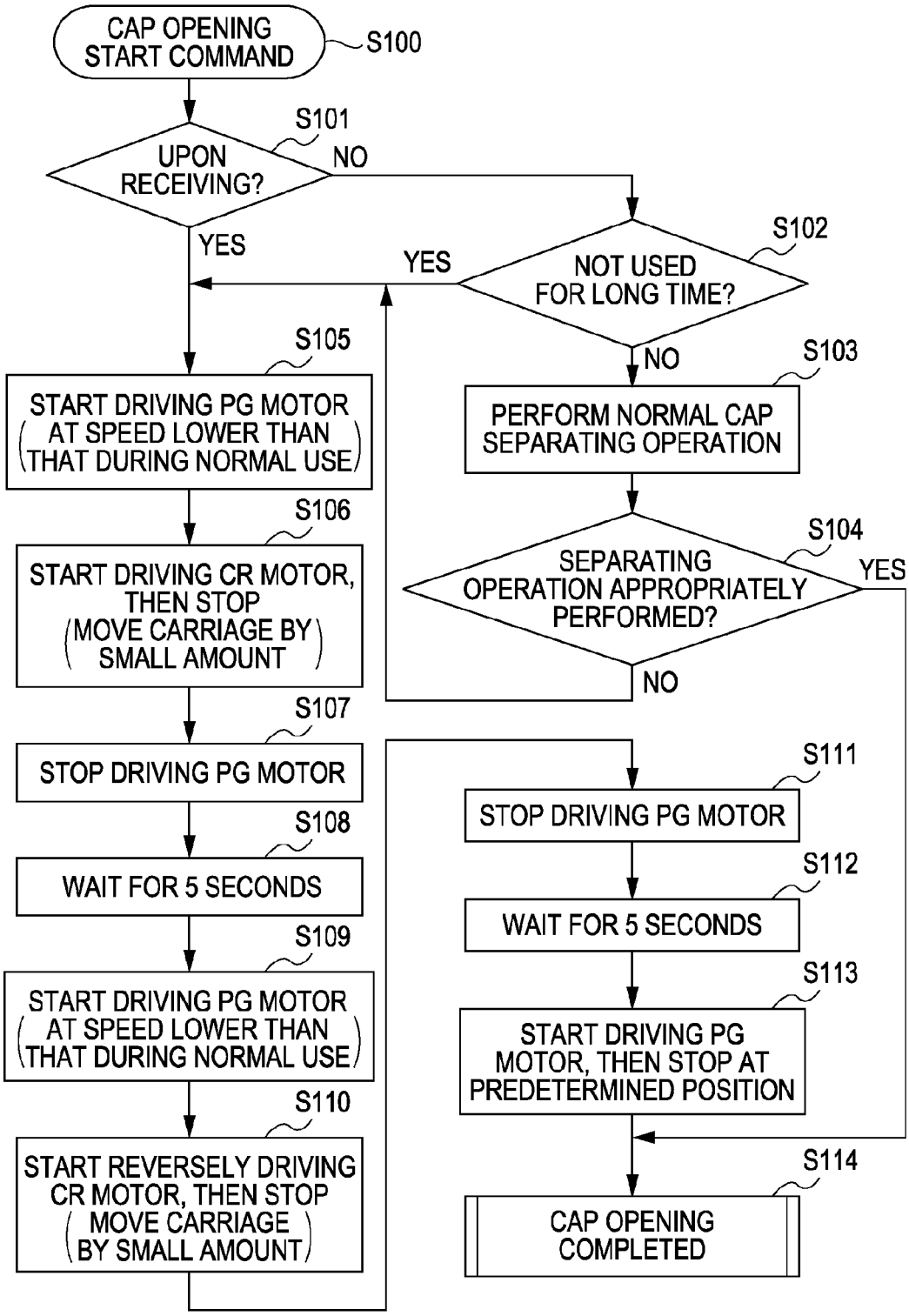
FIG. 7 is a flow chart illustrating an example control for a cap separating (cap opening) operation in the ink-jet recording apparatus according to the first exemplary embodiment of the present invention.

FIG. 7 is a flow chart illustrating an example control for a cap separating (cap opening) operation in the ink-jet recording apparatus according to the present embodiment.

In FIG. 7, a user operation such as pushing a power-on button or a recording start command, for example, triggers the cap opening operation (Step S100).

When a user receives the apparatus, this cap opening operation is performed first so that the cap 103 is separated from the recording head 1 and the carriage 2 can freely move to substantially the center of the apparatus such that the user can install ink tanks. During normal use, this cap opening operation is performed at the beginning of recording so that the carriage 2 can be reciprocated in the main scanning direction.

First, the control section 200 determines whether the operation is performed upon receiving the apparatus by a user (Step S101), and whether the apparatus is not used for a long period of time even when the apparatus is in normal use (Step S102). With this, it is determined whether the cap 103 may be firmly bonded to the ejecting surface of the recording head 1. When it is determined that the apparatus is not in the above-described states, a normal cap separating operation is performed (Step S103). At this moment, the control section 200 determines whether the cap separating operation is appropriately performed (Step S104). When the operation is not appropriately performed (No in Step S104), it is determined that the cap 103 is firmly bonded to the recording head 1.

The determinations in Steps S101 and S102 by the control section 200 are performed based on, for example, the information stored in an EEPROM (storage section 201) written before the apparatus is shipped from a manufacturing factory or the information from the built-in timer 202. For example, the factory shipping date of the ink-jet recording apparatus, which serves a preset product, and a reference time period are stored in the storage section 201 as time information. When the time period from when the ink-jet recording apparatus is shipped as a preset product to when a user turns the power of the apparatus on for the first use after purchase (upon receiving the apparatus) is longer than the reference time period, the control section 200 performs the separation process.

Moreover, the determination in Step S104 by the control section 200 is performed by, for example, detecting the position of a component in a mechanism that transmits the driving force for separating the cap 103 (for example, main cam 112). Alternatively, the determination in Step S104 by the control section 200 is performed by setting an operation limit value (for example, PWM value) of the driving source (for example, PG motor 106) for separating the cap 103 as a threshold.

When the control section 200 determines that the cap 103 may be firmly bonded to the recording head 1, the following control is performed. The PG motor 106 is driven at a speed lower than that during normal use, that is, a speed at which the cap holder 102 is lowered to a position shown in FIG. 5 by only the driving force of the PG motor 106 so that the cap 103 is pulled down from the recording head 1 (Step S105). Subsequently, the carriage 2 is moved a small amount by driving the CR motor 10 from the stopped state and by stopping the CR motor while the PG motor 106 is driven (Step S106). With these operations, an oblique separating force serving as the resultant force of the driving forces of both driving sources can act on the ejecting surface of the recording head 1 and the contact surface of the cap 103. Next, the PG motor is temporarily stopped (Step S107), and waits for a waiting (stopping) period (Step S108). With this, a state in which the oblique separating force acts on the contact surface can be maintained. This peeling method is more effective than applying an instantaneous force to the elastic cap 103.

Next, the drive of the PG motor 106 is restarted (Step S109), and the carriage 2 is moved a small amount in an opposite direction by reversely driving the CR motor 10 from the stopped state and by stopping the CR motor while the cap 103 is further pulled down (Step S110). Subsequently, the PG motor 106 is stopped (Step S111), and waits for a waiting period (Step S112). With this, the oblique separating force can act on the opposite side of the contact surface.

Thus, the cap 103 is separated from the recording head 1 by the PG motor 106 in a stepwise manner during the separation process.

The series of these operations triggers the separation of the contact surface of the cap 103 from that of the recording head 1. After this, normal operations are performed, that is, the PG motor 106 can be driven by a predetermined amount such that the cap 103 is lowered to a predetermined position (cap-open position), and can be stopped (Step S113). In this manner, the cap opening operation is completed (Step S114).

The series of the operations (Steps S105 to S112) for separating the cap is not limited to this exemplary embodiment, and can be used as appropriate depending on the features (for example, expected bonding force of the cap and the power of the driving sources) of the apparatus to be applied. For example, a firmer bonding state can be dissolved by, for example, repeating the above-described sequence a plurality of times or increasing the waiting period.

Figure 8:
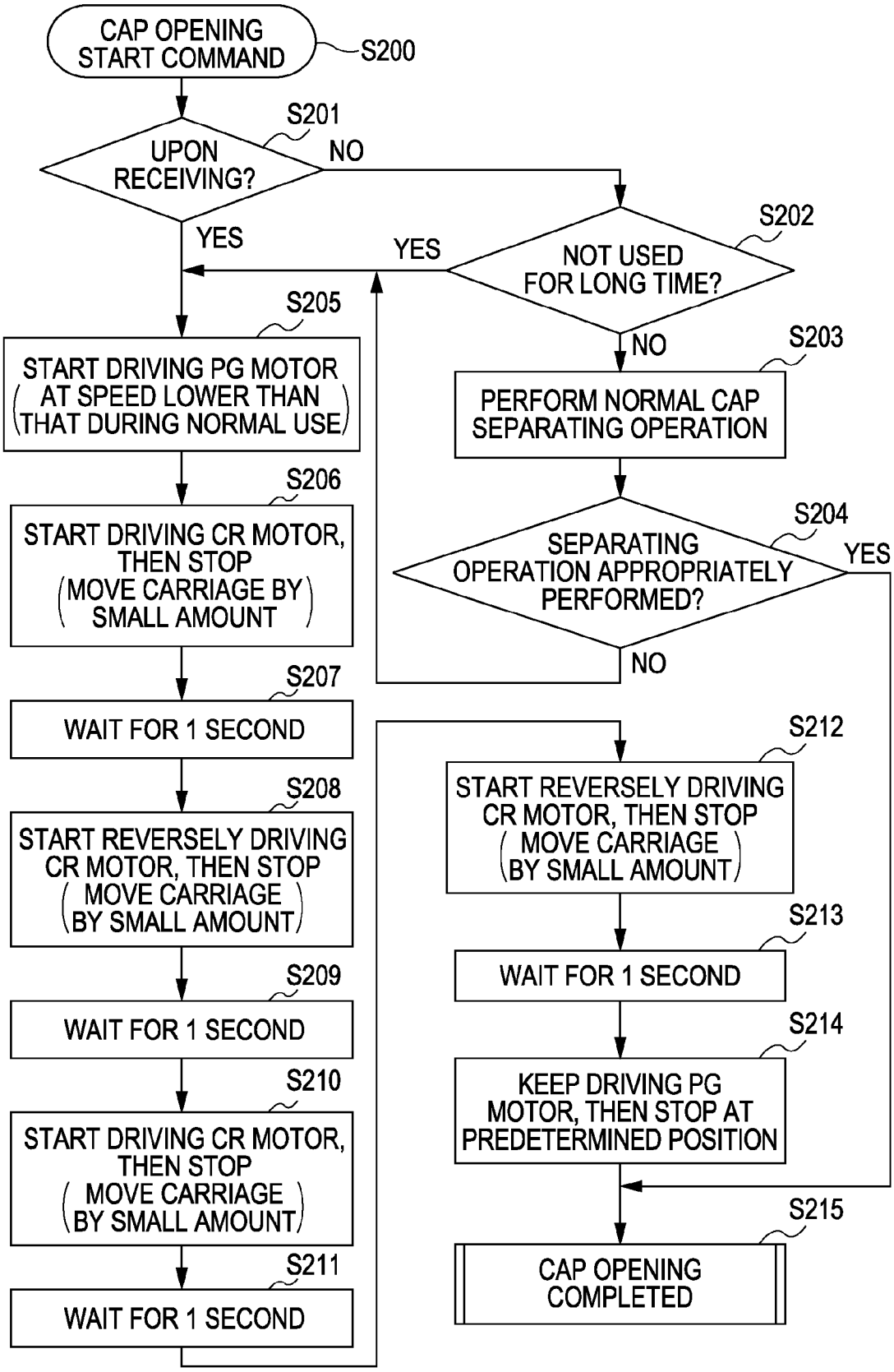
FIG. 8 is a flow chart illustrating another example control for the cap separating (cap opening) operation in the ink-jet recording apparatus according to the first exemplary embodiment of the present invention.

FIG. 8 is a flow chart illustrating another example control for the cap separating (cap opening) operation in the ink-jet recording apparatus according to the present embodiment.

In FIG. 8, steps from the command for starting the cap opening operation to the series of determination processes (Steps S201 to S204) are similar to those described with reference to FIG. 7.

When the control section 200 determines that the cap 103 may be firmly bonded to the recording head 1, the following control is performed so that the cap 103 is separated from the recording head 1. The PG motor 106 is driven at a speed lower than that during normal use, that is, a speed at which the cap holder 102 is lowered to a position shown in FIG. 5 by only the driving force of the PG motor 106 so that the cap 103 is pulled down from the recording head 1 (Step S205).

Subsequently, the carriage 2 is moved a small amount by driving the CR motor 10 from the stopped state and by stopping the CR motor while the PG motor 106 is driven (Step S206). After a waiting period (Step S207), the carriage 2 is moved by a small amount in the opposite direction by reversely driving the CR motor 10 from the stopped state and by stopping the CR motor (Step S208), and the CR motor 10 waits for a waiting period (Step S209). These operations are further repeated (Steps S210 to S213).

With this, the cap 103 is shaken by the second driving source in the direction orthogonal to the recording head 1 installed in the carriage 2 (left and right) while being gradually lowered by the first driving source. This motion triggers the separation of the contact surface of the cap 103 from that of the recording head 1, and facilitates the separation of the cap 103. After this, normal operations are performed, that is, the PG motor 106 is driven such that the cap 103 is lowered to a predetermined position (cap-open position), and is stopped (Step S214). In this manner, the cap opening operation is completed (Step S215).

The series of the operations (Steps S205 to S213) for separating the cap is not limited to the present embodiment, and can be used as appropriate depending on the features (for example, expected bonding force of the cap and the power of the driving sources) of the apparatus to be applied. For example, a firmer bonding state can be dissolved by, for example, repeating the above-described sequence a plurality of times or increasing the waiting period.

Figure 9:
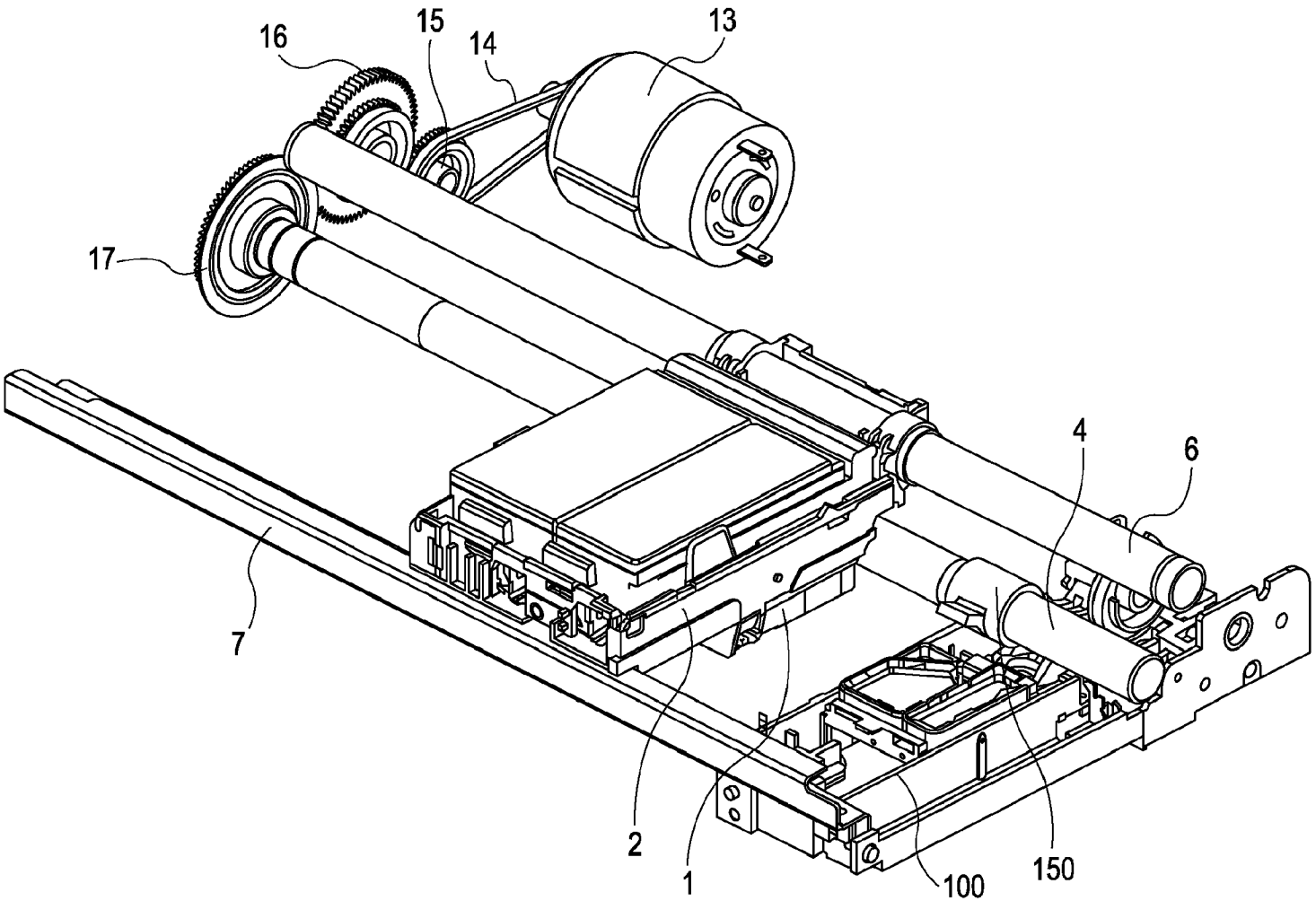
FIG. 9 is a schematic perspective view illustrating the structure of an ink-jet recording apparatus according to a second exemplary embodiment of the present invention.
Figure 10:
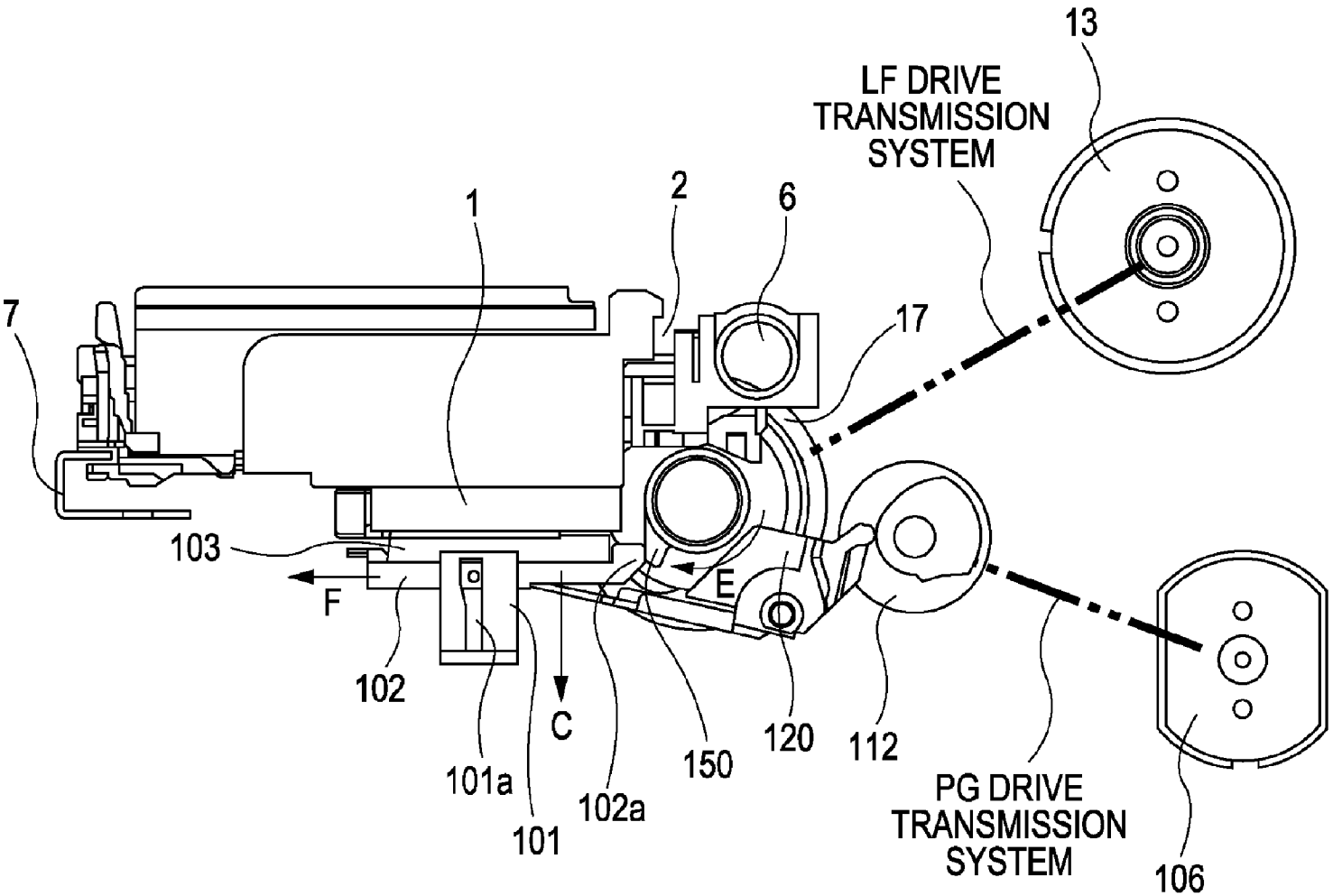
FIG. 10 is a schematic side view illustrating how the apparatus is operated from a capping state achieved by the structure shown in FIG. 9.

FIG. 9 is a schematic perspective view illustrating the structure of an ink-jet recording apparatus according to a second exemplary embodiment of the present invention. FIG. 10 is a schematic side view illustrating how the apparatus is operated from a capping state achieved by the structure shown in FIG. 9.

The structure shown in FIGS. 9 and 10 in which the cap 103 in the recovering unit 100 is rocked by the cap lever 120 to which the drive of the PG motor 106 serving as the first driving source is transmitted via the main cam 112 is substantially the same as that shown in FIGS. 3 and 4. However, the structure shown in FIGS. 9 and 10 differs in that a motor (LF motor) for a recording-medium conveying mechanism that conveys recording materials (sub-scanning) is used as the second driving source.

As shown in FIG. 9, the driving force of the LF motor 13 is transmitted to a conveying gear 17 integrated into the conveying roller 4 via a belt 14, an idler gear 15, and a speed change gear 16 such that the conveying roller is rotated and a recording material is conveyed. A cap open support lever 150 that assists the separation of the cap 103 is integrally disposed on the shaft of the conveying roller 4 in the vicinity of the recovering unit and is rotated when the conveying roller 4 is driven by the LF motor 13.

As shown in FIG. 10, the cap holder 102 having the cap 103 installed therein is moved in the cap opening direction (direction of the arrow C) by driving the PG motor 106 serving as the first driving source. At the same time, the LF motor 13 serving as the second driving source is driven so that the cap open support lever 150 is rotated in the direction of an arrow E and a cam surface 102*a* formed on the cap holder 102 is pressed. With this, the cap holder 102 can be moved by a small amount in the direction of an arrow F orthogonal to that of the arrow C. As a result, an oblique separating force acts on the contact surfaces of the recording head 1 and the cap 103, producing a similar effect as in the above-described exemplary embodiment.

Moreover, the cap separating operation described with reference to FIGS. 7 and 8 can be performed using the structure according to the present embodiment. This can also produce a similar effect.

The exemplary embodiments described with reference to FIGS. 3 to 6 and 9 to 10 can independently produce the above-described effects. However, the structures and the separation process can be combined as appropriate.

That is, the drive of the PG motor 106 for lowering the cap holder 102, the drive of the CR motor 10 for moving the carriage 2 right and left, and the drive of the LF motor 13 for moving the cap holder 102 back and forth can be performed at the same time. Alternatively, the drives can be alternately performed. In either case, a three-dimensional oblique separating force acts on the contact surfaces of the recording head 1 and the cap 103, and additional effects can be expected.

As described above, the present invention provides an ink-jet recording apparatus with high reliability and usability capable of effectively separating a cap member bonded to a recording head at low cost and only occupying a small space.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-209185 filed Aug. 10, 2007, which is hereby incorporated by reference herein in its entirety.

What is claimed is:

1. An ink-jet recording apparatus comprising:

a recording head configured to discharge ink onto a recording medium;

a cap unit configured to hold a cap member covering an ejection surface of the recording head and to move in a first direction so that the cap member is moved to a position where the cap member is in contact with the ejection surface and a position where the cap member is separated from the ejection surface;

a first motor configured to drive the cap unit in the first direction;

a carriage configured to mount and move the recording head;

a second motor configured to move the carriage in a second direction different from the first direction; and a control section configured to drive the first motor and the second motor, wherein the control section drives the second motor while driving the first motor to separate the cap member from the recording head.

2. The ink-jet recording apparatus according to claim 1, wherein the cap member is separated from the ejection surface by the first motor and the second motor driven at the same time in a stepwise manner.

3. The ink-jet recording apparatus according to claim 1, wherein the drive of the first motor or the second motor is stopped during a separating operation of the cap member.

4. The ink-jet recording apparatus according to claim 1, wherein the control section, in order to separate the cap member from the ejection surface, performs either a first movement for driving only the first motor or a second movement for driving the second motor while driving the first motor.

5. The ink-jet recording apparatus according to claim 4, wherein the driving speed of the first motor when performing the second movement is lower than the driving speed of the first motor when performing the first movement.

6. The ink-jet recording apparatus according to claim 4, wherein the second movement is performed when the control section determines that a separating operation of the cap member is not performed for a predetermined period based on information of a timer.

7. The ink-jet recording apparatus according to claim 4, wherein the second movement is performed when the control section determines that the first movement is not appropriately performed based on a position of a mechanism that transmits the driving force of the first motor to the cap member.

8. The ink-jet recording apparatus according to claim 4, wherein the second movement is performed when the control section determines that the driving operation of the first motor reaches an operation limit value and the first movement is not appropriately performed.

* * * * *